United States Patent [19]

Masumura

[11] 4,200,387

[45] Apr. 29, 1980

[54] IMAGE REVERSAL ELECTROSTATOGRAPHIC APPARATUS

[75] Inventor: Masao Masumura, Tokyo, Japan

[73] Assignee: Ricoh Company, Ltd., Tokyo, Japan

[21] Appl. No.: 927,535

[22] Filed: Jul. 24, 1978

[30] Foreign Application Priority Data

Jul. 29, 1977 [JP] Japan ..... 52-91158

[51] Int. Cl.[2] ..... G03G 15/00

[52] U.S. Cl. ..... 355/3 DD

[58] Field of Search ..... 355/3 R, 3 DD, 3 CH

[56] References Cited

U.S. PATENT DOCUMENTS

| | | | |
|---|---|---|---|
| 3,120,790 | 2/1964 | Carlson et al. | 355/3 R |
| 3,950,089 | 4/1976 | Fraser et al. | 355/3 DD |
| 3,977,778 | 8/1976 | Seko et al. | 355/3 R |

*Primary Examiner*—Fred L. Braun

*Attorney, Agent, or Firm*—David G. Alexander

[57] ABSTRACT

An electrostatic charge is applied to the entire surface of a photoconductive drum (12) and a light image of a negative original document (16) such as a microfilm is radiated onto an image area of the drum (12) to form an electrostatic image. A developing unit (17) applies a toner substance (18) charged with the same polarity as the electrostatic image to the drum (12) to develop the electrostatic image into a toner image. The toner adheres to areas of the electrostatic image having low potential, thereby forming a positive toner image which is transferred and fixed to a copy sheet (19). The developing unit (17) comprises a biasing member (22), (27) for producing an electric field of the same polarity as the electrostatic image for repelling the toner substance against the drum (12), the electric field being insufficiently strong to cause the toner substance to adhere to non-image areas of the drum (12).

1 Claim, 2 Drawing Figures

IMAGE REVERSAL ELECTROSTATOGRAPHIC APPARATUS

BACKGROUND OF THE INVENTION

The present invention relates to an image reversal electrostatographic apparatus for producing positive electrostatic copies of negative microfilm frames or the like.

In the conventional electrostatic process a photoconductive drum, belt or the like is uniformly charged and radiated with a light image of an original document such as a printed rage. The light image causes localized photoconduction and the formation of an electrostatic image on the drum. A toner substance is applied to the drum to develop the electrostatic image into a toner image which is transferred and fixed to a copy sheet to provide a permanent reproduction of the original document.

This process is a non-image reversal process, producing a positive copy of a positive document (or a negative copy of a negative document), and is not suitable for producing a positive copy of a negative microfilm frame or the like.

A problem inherent in the standard process is that it is impractical to use the entire surface of the photoconductive drum for electrostatic image formation. Therefore, non-image or border areas are provided around the image area. If the entire surface of the drum is electrostatically charged prior to imaging, the electrostatic charge in the non-image areas will be maximum and a maximum amount of toner substance will adhere thereto. This toner must be removed from the drum by a cleaning unit, often overloading the cleaning unit, and constitutes a major source of waste.

In an attempt to eliminate these undesired effects, it has been practiced in the prior art to eliminate charging the non-image areas by means of a timer or the like connected to control the charging means. In other words, the preliminary electrostatic charge is applied only to the image area of the drum.

In order to provide positive copies of negative original documents such as microfilm frames, a modification of the standard process has been developed. Whereas in the standard process toner particles charged with a polarity opposite to that of the electrostatic image are used, in the image reversal process toner particles charged with the same polarity as the electrostatic image are used. These particles adhere to the areas of low, rather than high electrostatic charge, and produce a reversed image copy.

However, where the non-image areas of the drum are not charged, the electrostatic potential in such areas being zero, a maximum amount of toner adheres to these areas in the image reversal process. This toner must be removed as in the standard process and constitutes a major source of waste as well as overloading the cleaning unit.

SUMMARY OF THE INVENTION

An image reversal electrostatographic apparatus embodying the present invention includes a photoconductive member and charging means for applying an electrostatic charge of a predetermined polarity to the photoconductive member. Imaging means radiate a light image onto the photoconductive member to form an electrostatic image. Developing means apply a toner substance to the photoconductive member to develop the electrostatic image into a toner image. The toner substance is electrostatically charged with a same polarity as the photoconductive member, and adheres to areas of the electrostatic image having low electrostatic charge. The apparatus is constructed in such a manner that the imaging means radiates the light image only onto an image area of the photoconductive member, the photoconductive member also being provided with a non-image area. The charging means charge the entire photoconductive member, the toner substance not adhering to the non-image area.

It is an object of the present invention to provide an image reversal electrostatographic apparatus in which adherence of toner to non-image areas of a photoconductive drum is positively prevented.

It is another object of the present invention to provide an image reversal electrostatographic apparatus in which waste of toner and overloading of a cleaning unit are positively prevented.

It is another object of the present invention to provide a generally improved electrostatographic apparatus.

Other objects, together with the foregoing, are attained in the embodiment described in the following description and illustrated in the accompanying drawing.

DESCRIPTION OF THE PREFERRED EMBODIMENT

Figure 1:
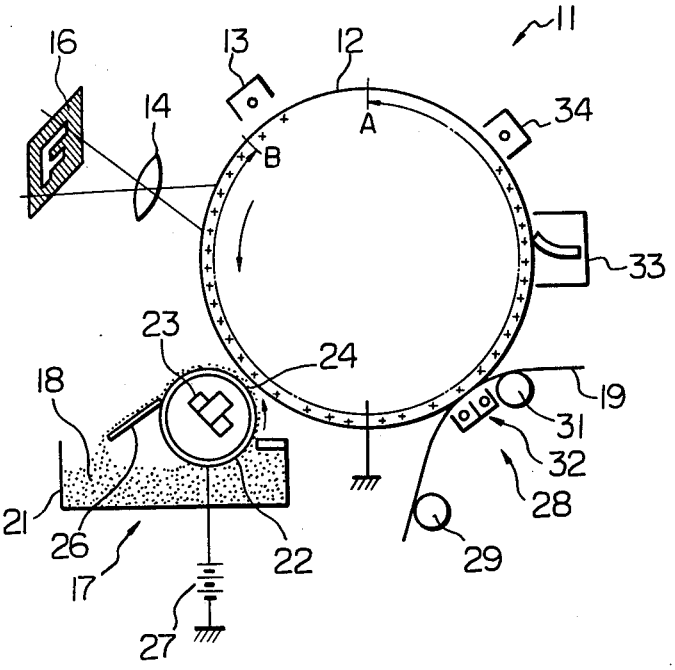
FIG. 1 is a schematic view of an electrostatographic apparatus embodying the present invention.

While the electrostatographic apparatus of the invention is susceptible of numerous physical embodiments, depending upon the environment and requirements of use, substantial numbers of the herein shown and described embodiment have been made, tested and used, and all have performed in an eminently satisfactory manner.

Referring now to the drawing, an electrostatographic apparatus embodying the present invention is shown as being in the form of an electrostatic copying machine and is generally designated by the reference numeral 11. The copying machine 11 comprises a rotary photoconductive drum 12 which is rotated counterclockwise at constant speed. A charging unit 13 applies an electrostatic charge to the drum 12. An imaging unit symbolically shown as being in the form of a converging lens 14 radiates a light image of an original document 16 onto the photoconductive drum 12 to form a light image through localized photoconduction. Typically, the document 16 is in the form of a negative microfilm frame or photographic negative.

Localized photoconduction occurs in the light portions of the image so that the electrostatic charge of the charging unit 13 is dissipated to a large extent. However, the charge is retained in the dark image areas since photoconduction does not occur.

A developing unit 17 then applies a toner substance 18 to the drum 12 to develop the electrostatic image into a toner image. Whereas the charging unit 13 applies a positive electrostatic charge to the drum 12 and the polarity of the electrostatic image is therefore positive, the toner substance 18 is also designed to be charged with a positive polarity.

The toner substance may comprise only resinous toner particles or a mixture of ferromagnetic carrier particles and resinous toner particles. In either case the toner particles are triboelectrically charged with the same polarity as the electrostatic image and urged into engagement with the drum 12. Since the toner particles are repelled by the image areas having a high positive charge, they adhere only to the image areas having a low charge.

Figure 2:
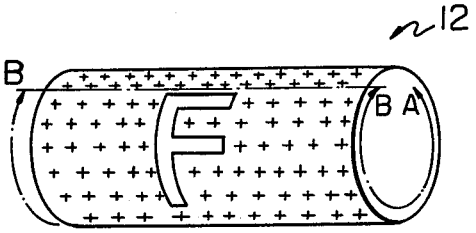
FIG. 2 is a perspective view of a photoconductive drum of the present apparatus having an electrostatic image formed thereon.

As illustrated, the document 16 is formed with a white letter "F" against a black background. The white "F" portion of the light image causes photoconduction and the dissipation of electrostatic charge on the drum 12, as illustrated in FIG. 2. Thus, the electrostatic charge in the "F" area of the electrostatic image on the drum 12 is very low. However, the electrostatic charge is high in the other areas of the electrostatic image.

Due to the high charge in the other areas of the electrostatic image, the toner particles adhere only to the "F" area. The toner particles are provided in a dark color such as black. Therefore, the toner image consists of a black letter "F" against a blank background. Where the toner image is transferred to a white copy sheet 19, the resulting copy will be in the form of a black letter "F" against a white background.

More specifically, the developing unit 17 comprises a developing tank 21 for containing the toner substance 18. A rotary metal sleeve 22 is partially immersed in the toner substance 18. A permanent magnet assembly 23 is fixedly mounted inside the sleeve 22. In the case where the toner substance 18 comprises magnetic carrier particles, these carrier particles magnetically adhere to the sleeve 22 carrying the toner particles therewith to form a magnetic brush 24 on the sleeve 22. The magnetic brush 24 brushingly engages the drum 12 for development. A scraper 26 removes unused toner substance 18 from the sleeve 22 and returns the same to the developing tank 21. A bias voltage source here shown as being in the form of a battery 27 applies a positive bias voltage to the sleeve 22 to repel the toner particles against the drum 12. This arrangement is especially advantageous since it provides excellent reproduction of solid images. The bias voltage applied to the sleeve 22 by the battery 27 is selected to create an electric field which is strong enough to cause the toner particles to adhere to the low charge (light image) areas but not to adhere to the high charge (dark image) areas of the drum 12.

A transfer unit 28 comprises feed rollers 29 and 31 for feeding the copy sheet 19 into engagement with the drum 12 at the same surface speed thereof and a transfer charger 32 for applying a negative charge to the back of the copy sheet 19 to transfer the positive toner image to the copy sheet 19. A fixing unit for fixing the toner image to the copy sheet 19 is not shown.

Further illustrated are a cleaning unit 33 for removing residual toner from the drum 12 and a discharge unit 34 for discharging the drum 12 prior to recharging by the charging unit 13.

In actual practice it is not possible to utilize the entire surface of the drum 12 for image formation, especially where the copying machine 11 must accommodate several different sizes of copy sheets. In addition to non-image or border areas at the axial ends of the drum 12 (not illustrated), a circumferential non-image or border area is provided extending clockwise from a point B to a point A. In other words, the electrostatic image is only formed on the drum 12 in an image area extending clockwise from the point A to the point B.

Prior art apparatus comparable to the present copying machine 11 comprise timers or the like to control the charging unit to electrostatically charge only the image area extending clockwise from A to B. Thus, the electrostatic potential on the drum 12 in the non-image area extending clockwise from B to A is zero. Toner particles are caused to adhere to the non-image area by the bias voltage applied to the sleeve 22 from the battery 27. This adhered toner must be removed by the cleaning unit 33, tending to overload the same, and is wasted.

This problem is completely overcome in the present copying machine 11 by charging the entire surface of the drum 12. In the non-image area extending clockwise from B to A, the high electrostatic charge repels the toner particles and prevents them from adhering to the drum 12 in the non-image area. Thus, overloading of the cleaning unit 33 and waste of toner is positively eliminated.

EXAMPLE

A photoconductive drum formed with a selenium photoconductive layer was charged over the entire surface thereof to an electrostatic potential of +800 V. The drum was then radiated with a light image to form an electrostatic image. A toner substance consisting of negatively charged, ferromagnetic carrier particles coated with a highly electrically resistive resin and positively charged toner particles was applied to the drum to develop the electrostatic image. A bias voltage of +600 V was applied to a sleeve of a developing unit of the type illustrated.

The resulting copy was of excellent quality. It was further observed that there were substantially no toner particles adhered to the non-image areas of the drum. Solid image areas were especially well reproduced.

Increase of the bias voltage beyond a certain value causes toner to adhere to the high charge areas of the electrostatic image and cause these areas to print grey rather than white. Decrease of the bias voltage below a certain lower value results in a reduction of image density. Therefore, the bias voltage is maintained at an optimum value which is determined experimentally.

In summary, it will be seen that the present invention provides an image reversal electrostatographic apparatus which produces excellent copies, eliminates waste of toner due to adherence thereof to non-image areas of a photoconductive drum and further prevents a drum cleaning unit from being overloaded. The present invention is applicable to various types of electrostatographic apparatus in addition to the particular apparatus described and illustrated.

The drum 12 may be replaced by a photoconductive belt, plate, sheet or the like. The present invention is applicable to, for example, a cascade type developing apparatus in which case a developing bias voltage is applied to an electrically charged electrode which supports a developer or to a semimoist developing apparatus in which case the developing bias voltage is applied to a developing tray. The present invention is also applicable to an electrostatic printing apparatus such as incorporated in a facsimile transceiver.

What is claimed is:

1. An electrostatographic apparatus including a photoconductive member, charging means for applying an electrostatic charge of a predetermined polarity to the photoconductive member and imaging means for radiating a light image onto the photoconductive member to form an electrostatic image, characterized by comprising developing means for applying a toner substance to the photoconductive member to develop the electrostatic image into a toner image, the toner substance being electrostatically charged with the same polarity as the photoconductive member and adhering to areas of the electrostatic image having low electrostatic charge;

the developing means comprising biasing means for urging the toner substance against the photoconductive member;

the biasing means comprising electric field producing means for producing an electric field having the same polarity as the photoconductive member for electrostatically repelling the toner substance against the photoconductive member;

the electric field being selected to be strong enough to cause the toner substance to adhere to the areas of the electrostatic image having low electrostatic charge but insufficiently strong to cause the toner substance to adhere to areas of the electrostatic image having high electrostatic charge;

the imaging means radiating the light image only onto an image area of the photoconductive member, the photoconductive member also being provided with a non-image area, the charging means charging the entire photoconductive member, the electric field being insufficiently strong to cause the toner substance to adhere to the non-image area.

* * * * *